US010442598B2

(12) United States Patent
May et al.

(10) Patent No.: US 10,442,598 B2
(45) Date of Patent: Oct. 15, 2019

(54) DISPENSER HAVING APPLICATOR CONNECTOR MEMBER

(71) Applicant: James Alexander Corporation, Blairstown, NJ (US)

(72) Inventors: Richard James May, Saylorsburg, PA (US); David G. Robinson, Newton, NJ (US); Ronald M. Douros, Stewartsville, NJ (US)

(73) Assignee: James Alexander Corporation, Blairstown, NJ (US)

( * ) Notice: Subject to any disclaimer, the term of this patent is extended or adjusted under 35 U.S.C. 154(b) by 113 days.

(21) Appl. No.: 15/635,798

(22) Filed: Jun. 28, 2017

(65) Prior Publication Data

US 2018/0002098 A1 Jan. 4, 2018

Related U.S. Application Data

(60) Provisional application No. 62/356,801, filed on Jun. 30, 2016.

(51) Int. Cl.
*B65D 81/32* (2006.01)

(52) U.S. Cl.
CPC ..... *B65D 81/3277* (2013.01)

(58) Field of Classification Search
CPC ..... B65D 81/3277
USPC ..... 401/133
See application file for complete search history.

(56) References Cited

U.S. PATENT DOCUMENTS

| | | | | |
|---|---|---|---|---|
| 1,822,566 | A * | 9/1931 | Davies | A61M 35/006 119/660 |
| 4,572,689 | A * | 2/1986 | Chernack | A46B 11/0013 401/132 |
| 5,098,297 | A * | 3/1992 | Chari | A61M 35/006 401/132 |
| 5,928,611 | A | 7/1999 | Leung | |
| 6,039,488 | A * | 3/2000 | Krawczyk | A01M 31/008 401/132 |
| 6,056,737 | A * | 5/2000 | Rosen | A61B 90/39 401/132 |
| 6,158,910 | A * | 12/2000 | Jolly | B25G 1/102 16/430 |
| 6,254,297 | B1 * | 7/2001 | Frazier | B43K 5/14 206/219 |
| 6,340,097 | B1 | 1/2002 | D'Alessio et al. | |
| 7,004,657 | B2 * | 2/2006 | Frazier | A46B 11/0003 401/133 |
| 9,089,870 | B2 * | 7/2015 | Frazier | B05C 17/00 |
| 2005/0111900 | A1 | 5/2005 | Fazzolari et al. | |

(Continued)

*Primary Examiner* — Huyen D Le
(74) *Attorney, Agent, or Firm* — Schacht Law Office, Inc.; Paul J. Nykaza

(57) ABSTRACT

A dispenser (10) for dispensing a flowable material M has a first container (12) configured to contain the flowable material M. The first container (12) is configured to be fracturable in response to a force applied thereto. A second container (14) has a first open end and a second closed end wherein the first container (12) is contained within the second container (14). The dispenser (10) further has an applicator assembly (16) operably positioned in the first open end of the second container (14) and defining a juncture therebetween. A connector member (18) is positioned proximate the juncture wherein the connector member (18) provides a compressive force proximate the juncture.

18 Claims, 4 Drawing Sheets

(56) References Cited

U.S. PATENT DOCUMENTS

| | | | | |
|---|---|---|---|---|
| 2005/0196431 | A1 | 9/2005 | Narang et al. | |
| 2010/0168638 | A1* | 7/2010 | Korogi | A61M 35/006 604/3 |
| 2014/0003858 | A1 | 1/2014 | Frazier | |
| 2016/0075168 | A1* | 3/2016 | Fehlmann | A46B 11/0003 401/133 |

* cited by examiner

DISPENSER HAVING APPLICATOR CONNECTOR MEMBER

CROSS-REFERENCE TO RELATED APPLICATIONS

The present application claims the benefit of U.S. Patent Application No. 62/356,801 filed on Jun. 30, 2016, which application is incorporated herein by reference.

FEDERALLY SPONSORED RESEARCH OR DEVELOPMENT

None.

TECHNICAL FIELD

The invention relates generally to a dispenser for a flowable material or substance and more particularly, to a dispenser having an applicator wherein the applicator has a reinforcing connector member.

BACKGROUND OF THE INVENTION

Dispensers having an applicator are well known in the art and are often designed to be single-use disposable dispensers. Certain dispensers incorporate a rupturable container such as a glass ampoule that contains a flowable material to be dispensed. The dispensers also incorporate an applicator that assists in dispensing the flowable material. One form of applicator is an applicator tip that is capable of dispensing individual droplets of the flowable material. The applicator can take other forms including a swab, roller tip or brush. Certain problems have been experienced with such dispensers including the applicator becoming disconnected from the dispenser. Glass shards from the ruptured glass ampoule have also inadvertently passed through the applicator or have punctured through the dispenser. The glass shards are then deposited in undesired areas or the glass shards can puncture through the dispenser and cause injury to the user.

While dispensers according to the prior art provide a number of advantageous features, they nevertheless have certain limitations. The present invention seeks to overcome certain of these limitations and other drawbacks of the prior art, and to provide new features and new uses not heretofore available. A full discussion of the features and advantages of the present invention is deferred to the following detailed description, which proceeds with reference to the accompanying drawings.

SUMMARY OF THE INVENTION

The present invention provides a dispenser having an applicator assembly with a reinforcing connector member.

According to a first aspect of the invention, a dispenser is provided for dispensing a flowable material. The dispenser has a first container configured to contain the flowable material. The first container is configured to be fracturable in response to a force applied thereto. A second container has a first open end and a second closed end wherein the first container is contained within the second container. The dispenser further has an applicator assembly operably positioned in the first open end of the second container and defining a juncture therebetween. A connector member is positioned proximate the juncture wherein the connector member provides a compressive force proximate the juncture.

According to another aspect of the invention, the first container is a glass ampoule, and the second container is made of resilient plastic.

According to another aspect of the invention, the applicator assembly has a base and protrusion extending from the base. The protrusion is positioned in the first open end of the second container in an interference fit. The applicator assembly further has a dropper tip member extending from the base and a central conduit extending through the applicator assembly from the protrusion to the dropper tip member.

According to further aspect of the invention, the connector member is a shrink-wrap material that provides a radially inwardly compressive force. The connector member shrinks inwardly in response to exposure to a heat source.

According to a another aspect of the invention, the connector member has a length that extends across the juncture. In an alternative embodiment, the length of the connector member extends along the second container wherein indicia is located on the connector member.

According to yet another aspect of the invention, the connector member has a thickness that provides a layer of protection from glass shards produced from fractionation of the first container.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION OF THE PREFERRED EMBODIMENT

Figure 1:
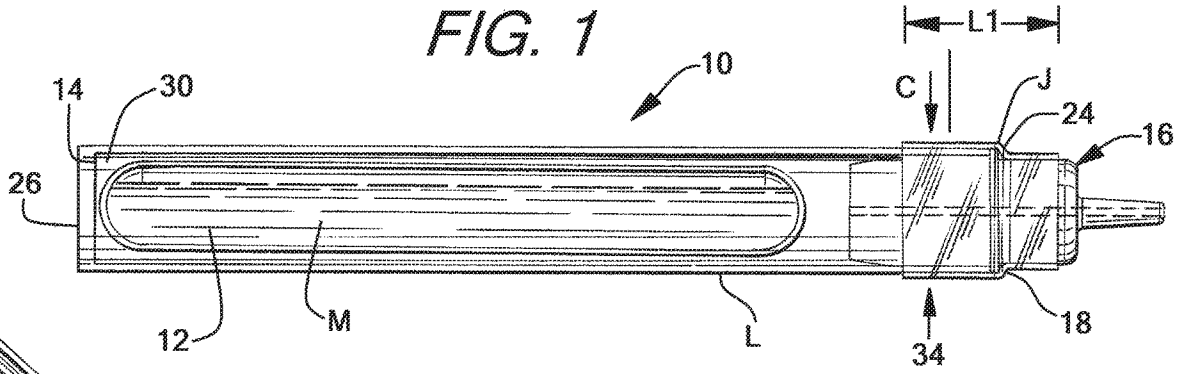
FIG. 1 is a side elevation view of a dispenser according to an exemplary embodiment of the present invention.
Figure 1A:
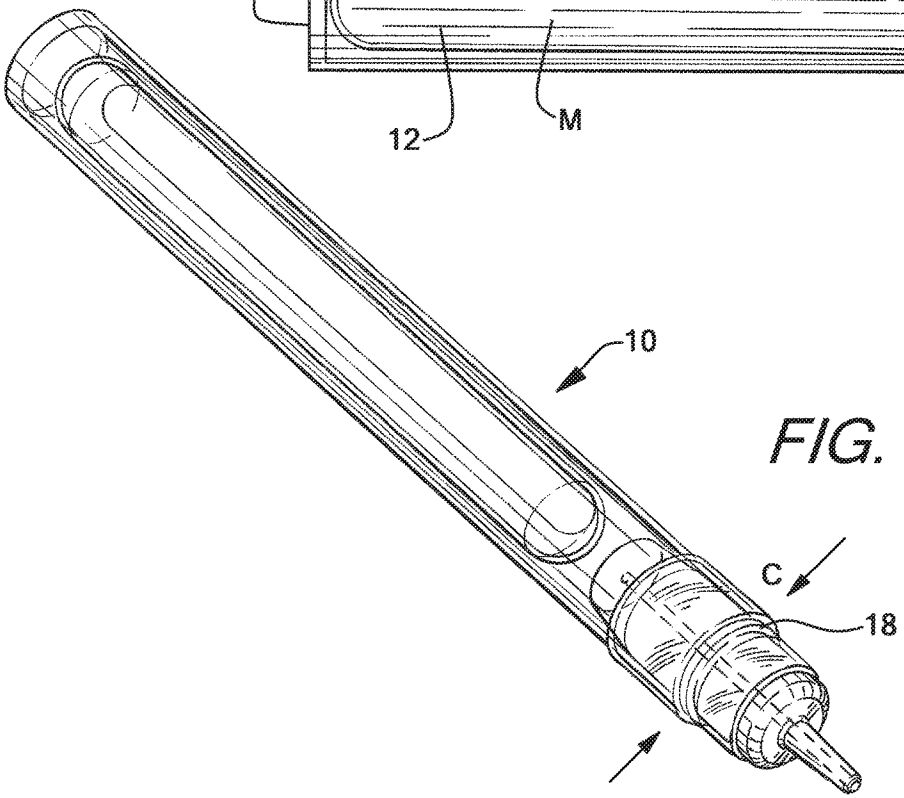
FIG. 1A is a perspective view of the dispenser of FIG. 1.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIG. 1 discloses a dispenser according to an exemplary embodiment of the invention and generally designated with the reference numeral 10. The dispenser 10 generally includes a first container 12, a second container 14, an applicator assembly 16 and a connector member 18. A cover member 20 (FIG. 2) may optionally be utilized as explained in greater detail below.

Figure 2:
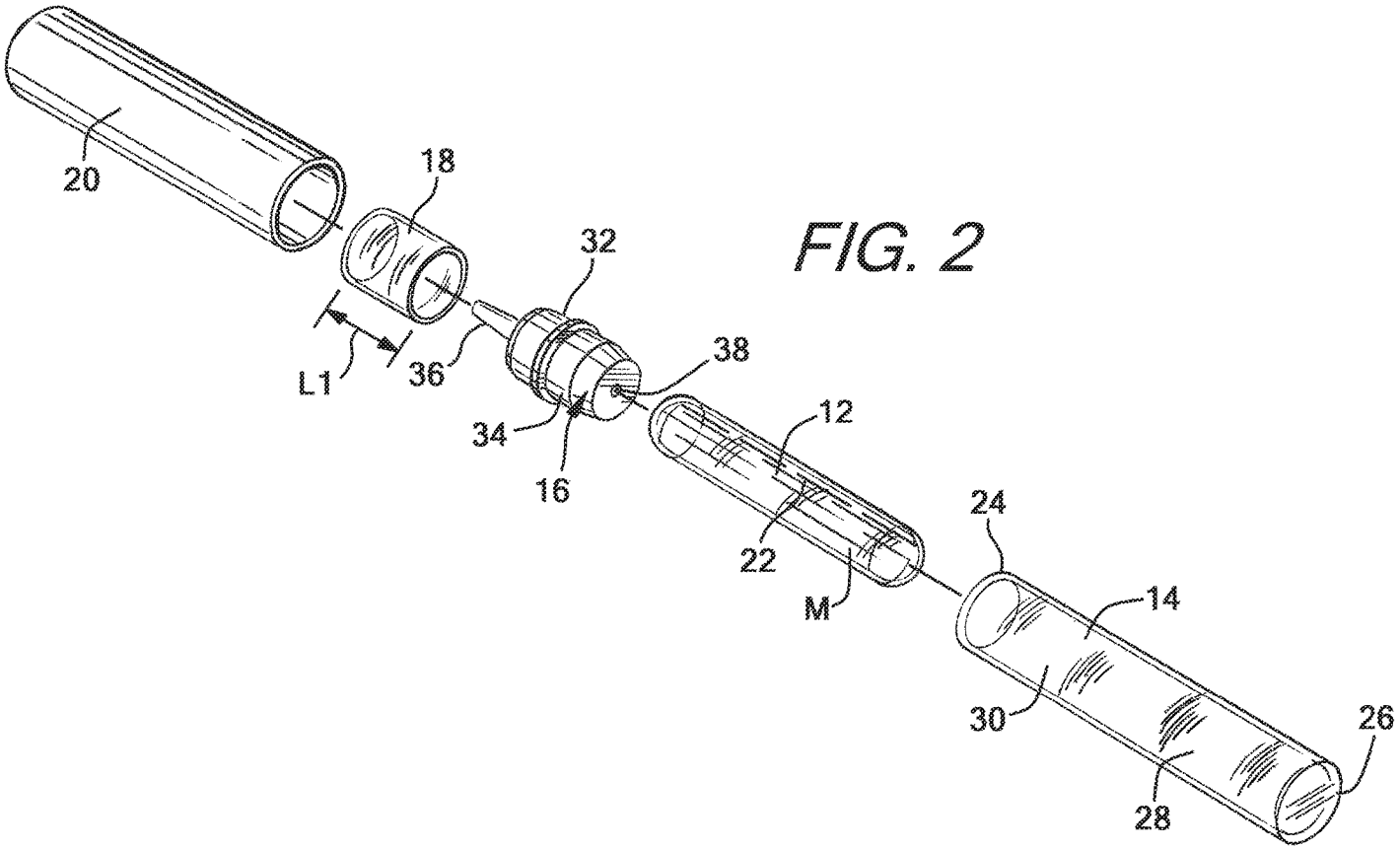
FIG. 2 is an exploded view of the dispenser of FIG. 1 and showing an optional cover member.

FIGS. 1-2 show the first container 12. The first container 12 is generally structured to contain the flowable material M to be dispensed from the dispenser 10. The flowable material M is typically a liquid in an exemplary embodiment. It is understood, however, that flowable materials in other forms could be used such as powders. The first container 12 defines a chamber 22 therein that contains the flowable material M. The first container 12 has a first end that is closed and also has a second end that is closed. The first container 12 is generally cylindrical in shape and has a generally circular cross-section. The first container 12 may be dimensioned to have a diameter and length to define the first chamber 22 in a size to contain a desired amount of the flowable material M. The first container 12 is designed to be fracturable or rupturable as described in greater detail below. In an exemplary embodiment, the first container 12 is made from a rigid fracturable material such as glass. The first container 12 may be a traditional glass ampoule. Glass ampoules are known in the art and provide a hermetically-sealed chamber for containing the flowable material M. In one exemplary embodiment, a single glass ampoule 12 is used. It is understood that the dispenser could be configured to use multiple glass ampoules 12.

FIGS. 1-2 further show the second container 14. The second container 14 has an open first end 24 and a closed second end 26, and an outer wall 28 therebetween. The outer wall 28 of the second container 14 defines a second chamber 30. The second chamber 30 is cooperatively dimensioned and configured to receive at least a portion of the first container 12, and typically the entire first container 12 is received in the second container 14. Thus, in an exemplary embodiment, the second container 14 is generally cylindrical and receives the first container 12 in a generally snug-fit configuration. The second container 14 is made from a flexible resilient material such as plastic in an exemplary embodiment. The second container 14 may be transparent or translucent plastic wherein the flowable material M in the first container 12 can be visible through the second container 14. The second container 14 may also be made from opaque material wherein the flowable material M or other contents are light sensitive.

FIGS. 1-2 further show the applicator 16 or applicator assembly 16. The applicator assembly 16 assists in dispensing the flowable material M from the dispenser 10 to a receiving surface. Any applicator assembly 16 that performs this function can be used in the dispenser 10. Thus, the applicator assembly 16 can take various forms including a dropper assembly, a swab assembly, a roller ball or a brush assembly. The swab applicator may also take various forms such as being made from absorbent, porous material, and that relies on a wicking action to dispense the flowable material M. It is also understood that the applicator assembly 16 may have a filter member operably associated therewith. The filter member is structured to allow passage of the flowable material M through the filter member while preventing passage of glass shards from the fractionated glass ampoule 12.

In an exemplary embodiment, the applicator assembly 16 is in the form of a dropper assembly. The applicator assembly 16 has a base 32 having a protrusion 34 extending therefrom at one end. The base 32 has a dropper tip member 36 extending from an opposite end. The applicator assembly 16 has a central conduit 38 extending therethrough from a distal end of the protrusion 34 to a distal end of the dropper tip member 36. The protrusion 34 has a generally annular configuration and is dimensioned to be received by the open first end 24 of the second container 14. In an exemplary embodiment, the protrusion 34 and the open first end 24 of the second container 14 are cooperatively dimensioned wherein the protrusion 34 is received in the open first end 24 in an interference fit. This connection will be described in greater detail below. As further described below, the applicator assembly 16 is configured to receive the flowable material M from the fractionated first container 12 and to dispense the flowable material M onto a receiving surface.

FIGS. 1-2 also show the connector member 18. The connector member 18 may be considered a reinforcing connector member 18 as described in greater detail below. The connector member 18 has an annular configuration and a length L1 dimensioned to span an interface area at the juncture J of the protrusion 34 of the applicator assembly 16 and the open first end 24 of the second container 14. The connector member 18 is structured to have a radially inward compressive force at this interface area defined by the juncture J as discussed in greater detail below. The inward compressive force is represented schematically by arrows C in FIGS. 1-2.

In one exemplary embodiment, the connector member 18 is in a band configuration and formed of a shrink-wrap material. The shrink-wrap material is typically a polymer plastic film such as a polyolefin film. Other films are possible such as PVC, polyethylene, polypropylene or other combinations of such films. The films could also have multiple layers and be coextruded depending on desired reinforcing characteristics. The shrink-wrap material could also be structured so as to shrink in certain directions to provide the desired reinforcing characteristics. The shrink-wrap material could also be a clear material or a colored material. The shrink-wrap material provides a radially compressive force when activated by being subjected to a heat source. The dispenser 10 can be subjected to a local heat source or the dispenser 10 can pass through a heat tunnel during the overall fabrication of the dispensers 10 wherein after the shrink-wrap connector member 18 is positioned accordingly, heat is applied and the material tightly shrinks against the applicator assembly 16 and the second container 14. The connector member 18 can be a solid, uninterrupted member but could also have spaced openings therethrough if desired. In addition, the connector member 18 may have a thickness that is uniform throughout the length L1 of the member 18. It is understood that the thickness of the connector member 18 could also vary along the length L1 of the member 18 to achieve a desired reinforcing structure.

While the connector member 18 is a shrink-wrap member in an exemplary embodiment, the connector member 18 can take other alternative forms. The connector member 18 could be a resilient elastic annular member such as being made from a rubber or polymeric material. The connector member 18 could also be made from a shrink-wrap-type material that is activated by mediums other than heat.

If desired, the dispenser 10 may also utilize a cover member 20. The cover member 20 is designed to initially cover the applicator assembly 16 prior to activating the dispenser 10 as can be appreciated from FIG. 2. The cover member 20 is dimensioned to fit snugly over the applicator assembly 16 and extend over a portion of the dispenser 10. One end of the cover member 20 may be closed although it is understood that both ends of the cover member 20 could be open ends. When preparing to activate the dispenser 10, the cover member 20 is removed from the dispenser 10 wherein an end of the dispenser 10 opposite of the applicator assembly 16 is inserted into the cover member 20. The cover member 20 may be a cardboard or paper-based material in an exemplary embodiment. It is also understood that the dispenser 10 can incorporate a label L as shown in FIG. 1.

To fabricate the dispenser, the first chamber 22 of the first container 12 is filled with a desired flowable material M. The open end of the first container 12 through which the flowable material passed to fill the first container 12 is sealed as is known in glass ampoule technology. A sealed glass ampoule 12 having the flowable material M therein is thereby provided (FIG. 2). The filled first container 12 is then inserted through the open first end 24 and into the second chamber 30 of the second container 14. Preferably, the first container 12 is positioned in its entirety within the second chamber 30 of the second container 14. Once the first container 12 is positioned in the second container 14, the applicator assembly 16 is connected to the second container 14. If a filter member is desired, the filter member can be inserted into the open first end 24 and of the second container 14 and adjacent one end of the first container 12. As can be appreciated from FIGS. 1-2, the protrusion 34 of the applicator assembly 16 is inserted into the open first end 24 of the second container 14. The protrusion 34 fits into the open first end 24 in an interference fit and is generally snugly secured and connected at the open first end 24. Thus, the external surface of the protrusion 34 engages an inner surface of the second container 14. The connector member 18 is provided to reinforce the connection of the applicator assembly 16 to the second container 14. In the exemplary embodiment shown in FIGS. 1-2, the connector member 18 is shrink band member wherein the shrink band member is an annular band that fits around the circumference of the applicator assembly 16 and the second container 14. The length L1 of the connector member 18 extends across the juncture J proximate the protrusion 34 of the applicator assembly 16 and the first open end 24 of the second container 14. The shrink band connector member 18 is subjected to a heat source wherein the shrink band connector member 18 contracts around the applicator assembly 16 and the second container 14. This contraction provides an inwardly-directed compressive force on the applicator assembly 16 and the second container 14, and in particular, at the juncture J of these connected components. This compressive force reinforces the connection of the applicator assembly 16 to the second container 14 significantly minimizing any chance that the applicator assembly 16 can become disconnected from the second container 14. The dispenser 10 is ready for activation and dispensing of the flowable material M.

It is understood that the dispenser 10 may utilized the cover member 20 in a single-use type container as described above and shown in FIG. 2. The dispenser 10 may also eliminate the cover member 20 and be packaged in other outer packaging such as blister packaging.

As discussed, a shrink band connector member 18 is provided in one exemplary embodiment. It is understood that other reinforcing connector members 18 could also be provided. For example, the applicator assembly 16 may have threads that screw into mating threads located on the second container 14. Adhesive members could also be used or other mechanical fastener members. In addition, the applicator assembly 16 could be solvent sealed, chemically bonded, or ultraviolet or radio frequency bonded to the second container 14.

Figure 3:
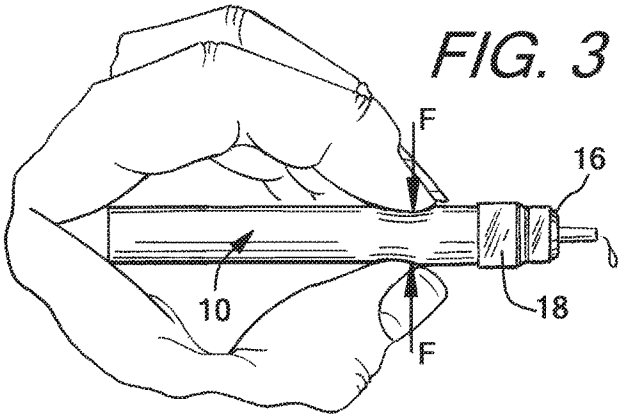
FIG. 3 is a partial side elevation view of a user activating the dispenser of FIG. 1.
Figure 4:
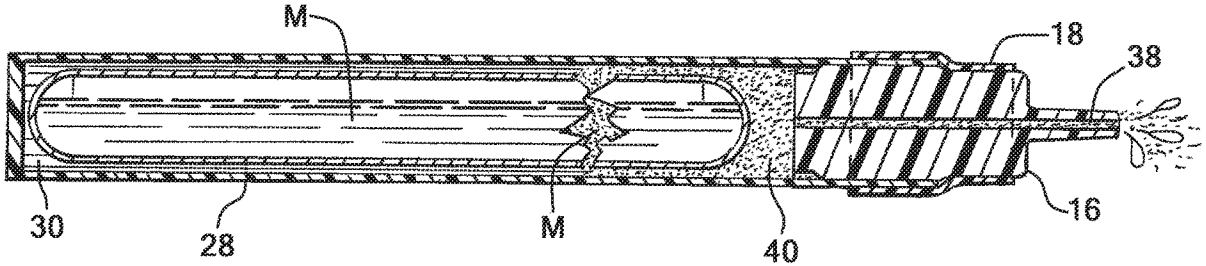
FIG. 4 is a cross-sectional view of the dispenser of FIG. 1 after activation.
Figure 5:
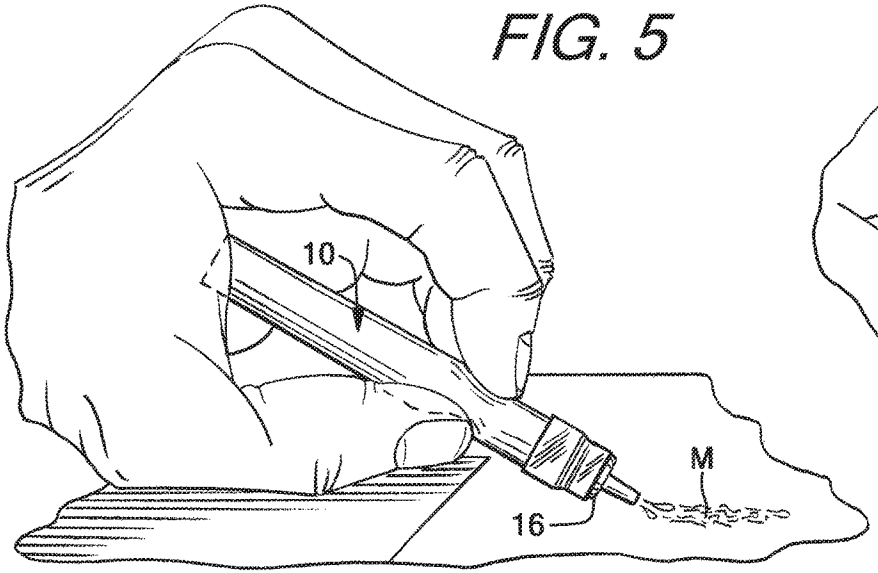
FIG. 5 is a partial schematic view of a user dispensing flowable material from the dispenser of FIG. 1 onto a receiving surface.

To dispense the flowable material M from the dispenser 10, the dispenser 10 is activated. Any outer packaging is removed or the cover member 20 is removed so that the closed second end 26 of the second container 14 is inserted into the cover member 20. As shown in FIG. 3, a user applies a squeezing or compressive force F through the second container 14 wherein the first container 12 is fractured or ruptured. The flowable material M contained in the first container 12 escapes into the second chamber 30 of the second container 14. As shown in FIG. 4, the flowable material M passes through the filter member 40 (used in this example) and into the central conduit 38 of the dropper tip member 36. As further shown in FIG. 5, the user applies the flowable material M to a receiving surface. It is understood that the filter member 40 prevents any glass shards from the fractionated glass ampoule 12 from passing into the dropper tip member 36. In addition, the outer wall 28 of the second container 14 prevents glass shards from cutting fingers of the user thereby protecting the user's fingers from injury by the fractionated glass shards of the glass ampoule 12 that remain in the second chamber 30 of the second container 14.

Figure 6:
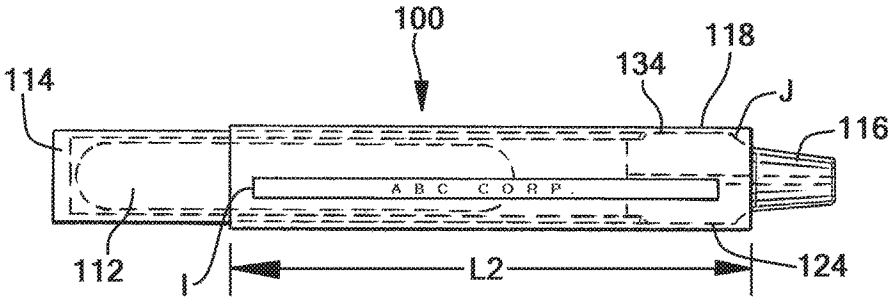
FIG. 6 is a side elevation view of a dispenser according to another exemplary embodiment of the present invention.

FIG. 6 discloses another embodiment of the dispenser 10 of the present invention. Many components of the dispenser are identical or similar in structure and will be referenced with like reference numerals in a 100 series. FIG. 6 discloses the dispenser designated with the reference numeral 100. The dispenser 100 generally includes a first container 112, a second container 114, an applicator assembly 116 and a connector member 118. The first container 112, the second container 114 and the applicator assembly 116 are generally identical to the components in FIGS. 1-5 and will not be further described.

FIG. 6 discloses the connector member 118. Similar to the connector member 18 of FIGS. 1-5, the connector member 118 is also a reinforcing connector member. The connector member 118 also has an annular configuration and a length L2. The length L2 is generally greater than the length L1 of the connector member 18 of FIGS. 1-5. The length L2 of the connector member 118 is dimensioned to span an interface area at the juncture J of the protrusion 134 of the applicator assembly 116 and the open first end 124 of the second container 14. The length L2 of the connector member 118 also extends further along the length of the second container 114 as shown in FIG. 6. The greater length L2 of the connector member 118 provides additional functional features as further described below. Similar to the connector member 18 of FIGS. 1-5, the connector member 118 is structured to have a radially inward compressive force at the interface area and juncture J as discussed in greater detail below. In one exemplary embodiment, the connector member 118 is formed of a shrink-wrap material. The shrink-wrap material provides a radially compressive force when activated by being subjected to a heat source. The connector member 118 can be a solid, uninterrupted member but could also have spaced openings therethrough if desired. In addition, the connector member 118 may have a thickness that is uniform throughout the length of the member 118. It is understood that the thickness of the connector member 118 could also vary along the length of the member 118 to achieve a desired reinforcing structure.

The length L2 of the connector member 118 extends further along the length of the second container 114. In an exemplary embodiment, the connector member 118 extends generally a majority of the length of the second container 114 and could extend an entire length of the second container 114 if desired. With an increased length L2, indicia I and other markings can be placed on the connector member 118. The indicia I can include branding information, instructions regarding dispenser use, material safety data, or flowable material content information etc. Accordingly, the connector member 118 serves multiple purposes. The connector member 118 provides a reinforcing connecting structure between the applicator assembly 116 and the second container 114. The connector member 118 also provides a space for printing indicia I thereon. Finally, the connector member 118 provides a further layer that helps prevent glass shards from the fractionated first container 112 from injuring a user. For example, if the glass shards penetrate through the second container 114, the connector member 118 provides another layer to protect fingers of the user.

While the connector member 118 is a shrink-wrap member in an exemplary embodiment, the connector member 118 can take other alternative forms. The connector member 118 could be a resilient elastic annular member such as being made from a rubber or polymeric material. The connector member 118 could also be made from a shrink-wrap-type material that is activated by mediums other than heat.

Figure 7:
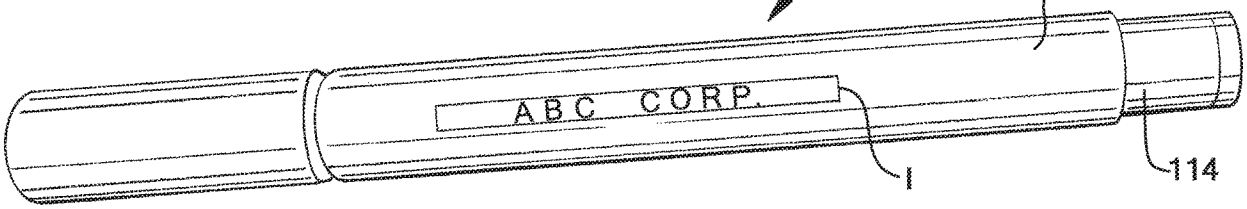
FIG. 7 is a side elevation view of a dispenser according to another exemplary embodiment of the present invention.

As shown in FIG. 6, the connector member 118 is connected to the applicator assembly 116 and the second container 114 is similar fashion as discussed above regarding FIGS. 1-5. It is understood that FIG. 6 shows the connector member 118 in a configuration prior to being subjected to a heat source to shrink the member 118. The connector member 118 is positioned over the applicator assembly 116 and the second container 114 and the connector member 118 is subjected to a heat source wherein the connector member 118 shrinks and compresses against the components to apply a reinforcing connection. The connector member 118 may be pre-labeled with the desired indicia. Alternatively, indicia I may be applied to the connector member 118 in a subsequent manufacturing step. FIG. 7 shows another dispenser similar to the dispenser in FIG. 6. The dispenser has the elongated connector member 118 that extends along a majority of the length of the second container 114. The connector member 118 has indicia I printed thereon. The connector member 118 in FIG. 7 provides a reinforcing connection, an area for printed indicia and another layer to guard against glass shards of the first container 112 from injuring the user. It is further shown that a removable cap could be used with the dispenser 100 to initially cover the applicator assembly 116.

It is further noted that although the embodiments described herein include a single first container 12 within the second container 14, it is understood that the dispenser 10 may include two or more first containers 12 located within the second container 14 while remaining within the scope and spirit of the present invention. Each of the plurality of first containers 12 would preferably be made of a rigid fracturable material, and be made of glass in an exemplary embodiment. Each of the plurality of first containers 12 would function in a way substantially similar to that otherwise described herein.

Additional alternative dispensers are also possible in other exemplary embodiments of the invention. For example, the connector member 18 can be incorporated into a plastic ampoule that does not utilize a glass ampoule. One type of plastic ampoule is an injected-molded member defining a chamber and having a rupturable membrane. A distal end adjacent the membrane typically receives an applicator assembly. The applicator assembly can be in any form as discussed herein and that assists in dispensing flowable material from the chamber to a receiving surface. Similar to the previous embodiments, the connector member fits around the distal end and in a shrink band embodiment, the shrink band connector member is subjected to heat and contracts. The connector member applies an radially inwardly compressive force to the applicator member and the distal end of the plastic ampoule (schematically shown, e.g., by arrows C in FIGS. 1-2). The connector member thereby provides a reinforcing support for the connection of the applicator assembly to the plastic ampoule, thus minimizing the chance that the applicator assembly can become disconnected from the dispenser. This situation can arise at times when the flowable material M requires more aggressive manipulation to dispense the material M. In certain configurations because of the materials being used, it is not possible to secure the applicator member such as solvent bonding or ultrasonic welding. The connector member disclosed herein is capable of assisting in the connection in these embodiments.

The dispenser of the present invention is designed to primarily contain and dispense flowable materials that are fluids. Other flowable materials can also be dispensed. For example, the flowable material could be a liquid, powder, gel or other type of flowable substance. Also, in other embodiments such as dispensers containing multiple chambers for different flowable materials, the flowable materials M1, M2 could both be fluids. In another embodiment, the first flowable material M1 could be a liquid, and the second flowable material M2 could be a powder to be mixed with the fluid. Other combinations depending on the use are also permissible.

This permits the dispenser 10 to be used in a wide variety of uses and applications, and contain and dispense a large variety of fluids and other flowable substances. The following is a non-exhaustive discussion regarding the many possible uses for the dispenser of the present invention, and in particular, the types of materials that are capable of being contained in the dispensers and dispensed therefrom. It is understood that related uses to those described below are also possible with the dispenser. It is also understood that the following discussion of potential uses is applicable to any of the dispenser embodiments disclosed and discussed herein.

In one example, the dispenser of the present invention can be used in medical applications. In one particular exemplary embodiment, the dispenser may contain a surgical antiseptic such as for cleaning and preparing a body area for incision, and sometimes referred to as a surgical prep solution. One type of antiseptic may be chlorohexadine gluconate (CHG). Other types of antiseptics could be iodine-based such as iodophoric skin tinctures, which are commercially available. Other antiseptics and antimicrobial agents could also include other iodine-based complexes, alcohol-based complexes or peroxides. Additional additives may also be used with the antiseptic such as colorants. A single chamber dispenser may be used in such an application, but a multi-chamber dispenser such as disclosed herein may also be used.

In another example, the dispenser of the present invention can be used in adhesive-type applications. The dispenser can dispense a flowable material or mixture that is an adhesive, epoxy, or sealant, such as an epoxy adhesive, craft glue, non-medical super glue and medical super glue. The dispenser could also be used with shoe glue, ceramic epoxy and formica repair glue. The dispenser could further be used for a variety of other adhesive dispensing applications, mastic-related resins or the like.

In another example, the dispenser of the present invention can be used in automotive applications. The dispenser can dispense a flowable material or mixture that is an automotive product, such as a rear view mirror repair kit, a vinyl repair kit, an auto paint touch up kit, a window replacement kit, a scent or air freshener, a windshield wiper blade cleaner, a lock de-icer, a lock lubricant, a liquid car wax, a rubbing compound, a paint scratch remover, a glass/mirror scratch remover, radiator stop-leak, a penetrating oil, or a tire repair patch adhesive.

In another example, the dispenser of the present invention can be used in chemistry-related applications. The dispenser can dispense a flowable material or mixture that is a chemistry material such as a laboratory chemical, a buffer solution, a rehydration solution of bacteria, a biological stain, or a rooting hormone. The dispenser may also be used as a chemical tester. In one such application, the dispenser can be used for testing drinks for various "date rape" drugs. Other types of chemical testers are also possible.

In another example, the dispenser of the present invention can be used to dispense a flowable material or mixture is a cosmetic and beauty supply/toiletry product. For example, the dispenser can be used for a nail polish, lip gloss, body cream, body gel, hand sanitizer, nail polish remover, liquid soaps, skin moisturizers, tooth whiteners, hotel samples, mineral oils, toothpastes, or mouthwash. The flowable material could also be a fragrance such as women's perfume or men's cologne.

The cosmetic applications could also include hair care type applications. In another particular example, the dispenser of the present invention can be used in a hair dye kit. Certain hair dye kits come in multiple components that are separately stored wherein the dispenser embodiment disclosed herein having a dividing wall that cooperates to define separate chambers can be utilized. Thus, the dispenser of the present invention can be used in a two-part hair care product such as a hair dye kit. A first flowable substance of the hair dye kit can be carried in the first chamber, and a second flowable substance of the hair dye kit can be carried in the second chamber. The membrane is ruptured wherein the two flowable substances can be mixed together to form a mixture or solution. The mixture or solution can then be dispensed from the dispenser onto the hair of a user. The dispenser can also dispense a flowable material or mixture in other hair care products, such as hair bleaches, hair streaking agent, hair highlighter, shampoos, other hair colorants, conditioners, hair gels, mousse, hair removers, or eyebrow dye.

In another example, the dispenser of the present invention can be used in crafting applications or stationary products. The dispenser can also dispense a large variety of stationery or craft products, such as magic markers, glitter gels, glitter markers, glitter glues, gel markers, craft clues, fabric dyes, fabric paints, permanent markers, dry erase markers, dry eraser cleaner, glue sticks, rubber cement, typographic correction fluids, ink dispensers and refills, paint pens, counterfeit bill detection pen, envelope squeeze moisturizers, adhesive label removers, highlighters, and ink jet printer refills.

In another example, the dispenser of the present invention can also dispense a flowable material or mixture that is an electronics-related product. For example, the electronics product could be a cleaning compound, a telephone receiver sanitizer, a keyboard cleaner, a cassette recorder cleaner, audio/video disc cleaner, a mouse cleaner, or a liquid electrical tape.

In another example, the dispenser of the present invention can dispense a flowable material or mixture in food product applications. For example, the food product may be food colorings, coffee flavorings, spices, food additives, drink additives, confections, cake gel, pastry gel, frostings, sprinkles, breath drops, condiments, sauces, liquors, alcohol mixes, energy drinks, or herbal teas and drinks.

In another example, the dispenser of the present invention can be used in home repair product and home improvement applications. The dispenser can also dispense a flowable material that is a home repair product, such as a caulking compounds or materials, a scratch touch up kit, a stain remover, a furniture repair product, a wood glue, a patch lock, screw anchor, wood tone putty or porcelain touch-up. The dispenser could also dispense a plumbing flux applicator, rust remover and tree wound treatment. In certain home repair or home improvement applications, the dispenser can be used in paint applications. The dispenser can dispense a variety of paint products such as general paints including interior/exterior paints, novelty paints, paint additives, wood stain samples, varnishes, stains, lacquers, caulk, paint mask fluid or paint remover.

In another example, the dispenser of the present invention can be used in household related products. For example, the dispenser could be used for cleaning agents, pest control products, a fish tank sealant or a fish tank treatment, a leak sealant, a nut/bolt locker, screw tightener/gap filler, a super glue remover or goo-b-gone. The dispenser could also be used for a colorant dispenser, or disinfectants, a plant food, or a cat litter deodorant. The dispenser could also dispense toilet dyes and treatments, eyeglass cleaners, shoe polishes, clothing stain removers, carpet cleaners and spot removers, multi-purpose oils, and ultrasonic cleaner concentrate. The household product could include a variety of pet-related products including but not limited to an animal medicine dispenser, pet medications, animal measured food dispenser, pet shampoos or odor eliminator liquids. A large variety of pest control products can be dispensed by the dispenser, including insect attractants, pesticides, pet insect repellants, pest sterilizers, insect repellants, lady bug attractant and fly trap attractant.

In another example, the dispenser of the present invention can be used in lubricant applications. The dispenser can dispense a large variety of lubricants including industrial lubricants, oils, greases, graphite lubricants or a dielectric grease.

The dispenser of the present invention can also be used in other medical applications including medical related products and medicinal products. Additional medical related product applications can include skin adhesive kits to be used in place of traditional stitching products. As discussed, the dispenser could also be used with topical antiseptics and antimicrobials. In addition, the dispenser 10 can dispense a large variety of medicinal products, such as blister medicines, cold sore treatments, insect sting and bite relief products, skin cleaning compounds, skin rash lotions, tissue markers, topical antimicrobials, topical demulcent, treatments for acne such as acne medications, umbilical area antiseptics, cough medicines, waterless hand sanitizers, toothache remedies, cold medicines and sublingual dosages. The dispenser could also be used in conjunction with a medical device product.

In another example, the dispenser of the present invention can be used in novelty products. For example, the dispenser can contain materials in a glow-stick device. In such instance, the dispenser is a container that may contain multiple components separately stored until activation to create a glowing state in response to mixture of the components. Furthermore, the dispenser can dispense a flowable material or mixture that is a chemiluminescent light, a Christmas tree scent, a glitter gel, and a face paint. Other types of novelty paints could also be used with the dispenser.

In another example, the dispenser of the present invention can be used in sports products. The dispenser can dispense a variety of sports products including sports eye black, football hand glue, and baseball glove conditioner and pine tar. The dispenser can also dispense wildlife lures. The dispenser can be used in various camping related applications including portable lighting fuels for camp lights or other devices and tent repair kits. The dispenser can also be used in bingo or other game markers.

In another example, the dispenser of the present invention can be used in test kit applications. The dispenser can dispense a flowable material or mixture that is a test kit, such as a lead test kit, a drug kit, a radon test kit, a narcotic test kit, a swimming pool test kit (e.g., chlorine, pH, alkalinity etc.), a home water quality tester, a soil test kit, a gas leak detection fluid, a pregnancy tester, or a respirator test kit. The dispenser can also dispense a flowable material or mixture that as part of a medical device test kit, such as a culture media, a drug monitoring system, a microbiological reagent, a streptococcus test kit, or a residual disinfectant tester. The dispenser may also be used in diagnostic testing kits, explosive testing kits or other test kits. The dispenser can be used in breathalyzer tests, culture media samples and drug test kits.

In another example, the dispenser of the present invention can be used in personal care products or wellness-related products. The dispenser can also dispense a flowable material or mixture that is a personal care product, such as shaving cream or gel, aftershave lotion, skin conditioner, skin cream, skin moisturizer, petroleum jelly, insect repellant, personal lubricant, ear drops, eye drops, nose drops, corn medications, nail fungal medication, aging liquids, acne cream, contact lens cleaner, denture repair kit, finger nail repair kit, liquid soaps, sun screen, lip balm, tanning cream, self-tanning solutions, eye wash solution finger nail repair kits. The dispenser can also be used with aroma therapy products and homeopathic preparations. The dispenser can also dispense various vitamins, minerals, supplements and pet vitamins.

The dispenser can also dispense a flowable material or mixture in a variety of other miscellaneous applications. Such miscellaneous applications may include, but not be limited to use in connection with a suction device for culture sampling, taking various liquid samples or taking various swabbing samples. The dispenser could also be used for float and sinker devices, dye markers, microbiological reagents, and also for manufacturing parts assembly liquids and irrigation solutions. The dispenser may also be used as a chalk dispenser such as in construction applications.

Thus, the dispenser can be used in many different applications including mechanical, chemical, electrical or biomedical uses. The dispenser can dispense any variety of flowable materials including liquids and powders, and further including a liquid and a powder, two or more powders, or two or more liquids. The dispenser may be used as part of 2-part system (mix before use) including a liquid with a powder, a liquid with a liquid, a powder with a powder, or sealed inside another tube or product container or partially sealed, connected or attached to another container. The dispenser may also be used as part of a plunger dispensing system.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A dispenser for dispensing a flowable material, the dispenser comprising:

a first container configured to contain the flowable material, the first container configured to be fracturable in response to a force applied thereto;

a second container having a first open end and a second closed end wherein the first container is contained within the second container;

an applicator assembly positioned in the first open end of the second container wherein an external surface of the applicator assembly engages an inner surface of the second container and defining a juncture between the applicator assembly and the first open end of the second container;

a connector member positioned proximate the juncture, the connector member having a length dimensioned to span the juncture, the connector member providing a compressive force proximate the juncture.

2. The dispenser of claim 1 wherein the first container is a glass ampoule.

3. The dispenser of claim 1 wherein the second container is made of resilient plastic.

4. The dispenser of claim 1 wherein the applicator assembly has a base and protrusion extending from the base, the protrusion positioned in the first open end of the second container in an interference fit.

5. The dispenser of claim 4 wherein the applicator assembly has a dropper tip member extending from the base, the applicator assembly having a central conduit extending through the applicator assembly from the protrusion to the dropper tip member.

6. The dispenser of claim 1 wherein the connector member is a shrink-wrap material that provides a radially inwardly compressive force.

7. The dispenser of claim 1 wherein the length of the connector member extends along the second container wherein indicia is located on the connector member.

8. The dispenser of claim 1 wherein the connector member has a thickness and provides a layer of protection from glass shards produced from fractionation of the first container.

9. The dispenser of claim 1 further comprising a removable cover member positioned over the applicator assembly.

10. The dispenser of claim 1 wherein the connector member is a rubber band member.

11. The dispenser of claim 1 further comprising a label member positioned over a length of the second container, the label member having indicia thereon.

12. The dispenser of claim 11 wherein the connector member is integral with the label member.

13. The dispenser of claim 1 wherein the connector member has a first segment extending across the juncture and a second segment extending along a length of the second container.

14. The dispenser of claim 1 wherein the connector member is of a clear material.

15. The dispenser of claim 1 wherein the connector member is of an opaque material.

16. A dispenser for dispensing a flowable material, the dispenser comprising:

a first container configured to contain the flowable material, the first container configured to be fracturable in response to a force applied thereto;

a second container having a first open end and a second closed end wherein the first container is contained within the second container;

an applicator assembly operably positioned in the first open end of the second container and defining a juncture therebetween;

a shrinkwrap member having a first segment and a second segment, the first segment positioned proximate the juncture and providing a compressive force proximate the juncture on outer surfaces of the applicator assembly and the second container, the second segment extending along a length of an outer surface of the second container and defining a label portion, and having indicia on the label portion.

17. A dispenser for dispensing a flowable material, the dispenser comprising:

a first container configured to contain the flowable material, the first container configured to be fracturable in response to a force applied thereto, the first container being a glass ampoule;

a second container having a first open end and a second closed end wherein the first container is contained within the second container, the second container being of a resilient plastic material;

an applicator assembly operably positioned in the first open end of the second container, the applicator assembly having a base and protrusion extending from the base, the protrusion positioned in the first open end of the second container in an interference fit and defining a juncture at an interface area between the base and an annular edge of the second container defining the first open end, the applicator assembly further having a dropper tip member extending from the base, the applicator assembly having a central conduit extending through the applicator assembly from the protrusion to the dropper tip member;

a shrinkwrap member having a first segment and a second segment, the first segment positioned proximate the interface area and across the juncture and around an outer surface of the applicator assembly and an outer surface of the second container and providing a compressive force proximate the juncture, the second segment extending along a length of the outer surface of the second container and defining a label portion, and having indicia on the label portion.

18. A dispenser for dispensing a flowable material, the dispenser comprising:

a first container in the form of a glass ampoule configured to contain the flowable material, the first container configured to be fracturable in response to a force applied thereto;

a second container having a first open end and a second closed end wherein the first container is entirely contained within the second container;

an applicator assembly having a protrusion positioned in the first open end of the second container wherein an external surface of the protrusion engages an inner surface of the second container and defining a juncture between the applicator assembly and the first open end of the second container;

a shrinkwrap connector member positioned at the juncture, the shrinkwrap connector member having a length dimensioned to span the juncture and engage outer surfaces of the applicator assembly and the second container, the shrinkwrap connector member providing a radially inward compressive force at the juncture.

* * * * *